US009273565B2

(12) United States Patent
Propheter-Hinckley

(10) Patent No.: US 9,273,565 B2
(45) Date of Patent: Mar. 1, 2016

(54) VANE ASSEMBLY FOR A GAS TURBINE ENGINE

(75) Inventor: Tracy A. Propheter-Hinckley, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 1002 days.

(21) Appl. No.: 13/401,872

(22) Filed: Feb. 22, 2012

(65) Prior Publication Data

US 2013/0216361 A1 Aug. 22, 2013

(51) Int. Cl.
*F01D 9/04* (2006.01)
*F01D 17/16* (2006.01)

(52) U.S. Cl.
CPC ..... *F01D 17/162* (2013.01); *F01D 9/041* (2013.01); *F05D 2230/64* (2013.01); *Y10T 29/49321* (2015.01)

(58) Field of Classification Search
CPC ..... F01D 9/02; F01D 9/04; F01D 9/041; F01D 9/042; F01D 17/145; F01D 17/162; F01D 17/165; F01D 17/16; F01D 17/10; F01D 17/12; F05D 2240/12; F05B 2240/12
See application file for complete search history.

(56) References Cited

U.S. PATENT DOCUMENTS

| | | | | |
|---|---|---|---|---|
| 3,075,744 | A * | 1/1963 | Peterson | 415/115 |
| 3,224,194 | A | 12/1965 | Feo et al. | |
| 3,910,716 | A * | 10/1975 | Roughgarden et al. | 415/209.2 |
| 3,966,352 | A | 6/1976 | White et al. | |
| 4,013,377 | A * | 3/1977 | Amos | 415/161 |
| 4,688,992 | A | 8/1987 | Kirkpatrick et al. | |
| 5,222,863 | A | 6/1993 | Jones | |
| 5,593,282 | A | 1/1997 | Krueger | |
| 5,735,673 | A | 4/1998 | Matheny et al. | |
| 5,931,636 | A | 8/1999 | Savage et al. | |
| 7,168,919 | B2 | 1/2007 | Blatchford et al. | |
| 7,217,081 | B2 * | 5/2007 | Scheurlen et al. | 415/1 |
| 7,654,797 | B2 | 2/2010 | Boegli et al. | |
| 8,007,229 | B2 | 8/2011 | McCaffrey et al. | |
| 2004/0109762 | A1 * | 6/2004 | Hidalgo et al. | 415/209.3 |
| 2004/0141839 | A1 * | 7/2004 | Weaver | 415/210.1 |
| 2006/0078420 | A1 | 4/2006 | Barbe et al. | |

(Continued)

FOREIGN PATENT DOCUMENTS

EP 1967718 B1 5/2013

OTHER PUBLICATIONS

International Search Report and Written Opinion for International Application No. PCT/US2013/025036 completed on May 13, 2013.

(Continued)

*Primary Examiner* — Edward Look
*Assistant Examiner* — Danielle M Christensen
(74) *Attorney, Agent, or Firm* — Carlson, Gaskey & Olds

(57) ABSTRACT

A vane assembly for a gas turbine engine according to an exemplary embodiment of this disclosure includes, among other possible features, a first platform, a second platform spaced from the first platform, and a first variable airfoil that extends radially across an annulus between the first platform and the second platform. One of a radial outer portion and a radial inner portion of the variable airfoil includes a rotational shaft and the other of the radial outer portion and the radial inner portion includes a ball and socket joint that rotationally connect the first variable airfoil relative to the first platform and the second platform.

11 Claims, 7 Drawing Sheets

(56) References Cited

U.S. PATENT DOCUMENTS

| | | | |
|---|---|---|---|
| 2009/0097966 | A1 | 4/2009 | McCaffrey |
| 2009/0104022 | A1 | 4/2009 | Suljak, Jr. et al. |
| 2010/0284815 | A1 | 11/2010 | Parker et al. |

OTHER PUBLICATIONS

International Preliminary Report on Patentability for International Application No. PCT/US2013/025036 mailed Sep. 4, 2014.

* cited by examiner

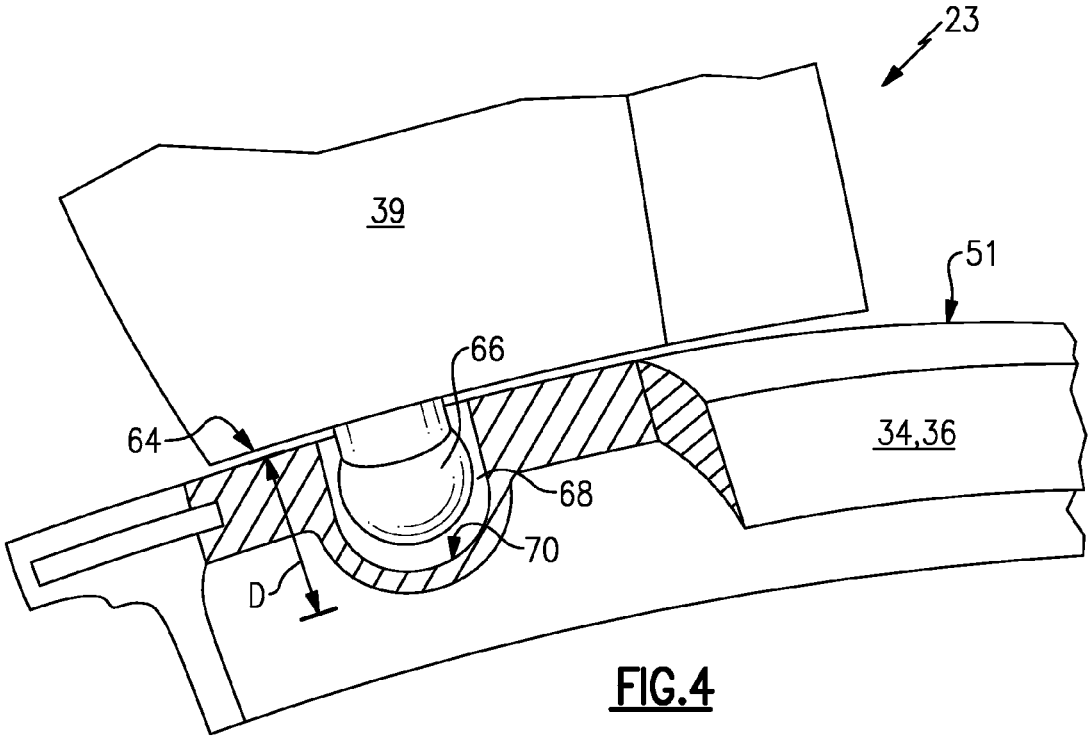
FIG.4
FIG.5
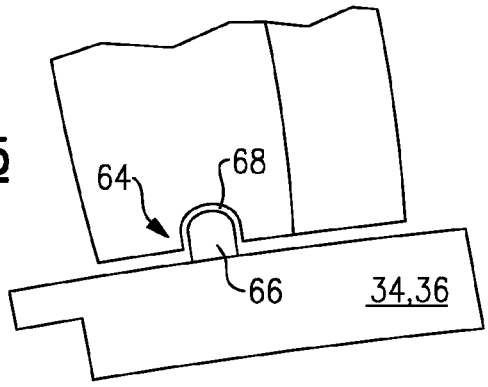

VANE ASSEMBLY FOR A GAS TURBINE ENGINE

This invention was made with government support under Contract No. FA8650-09-D2923-DO 0013 awarded by the United States Air Force. The government has certain rights in this invention.

BACKGROUND

This disclosure relates to a gas turbine engine, and more particularly to a vane assembly for a gas turbine engine.

Gas turbine engines, such as those which power modern commercial and military aircraft, typically include a compressor section, a combustor section and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other gas turbine engine loads.

The compressor section and the turbine section of the gas turbine engine typically include alternating rows of rotating blades and stationary vanes. The rotating blades create or extract energy from the airflow that is communicated through the gas turbine engine, and the vanes direct the airflow to a downstream row of blades. The vanes can be manufactured to a fixed flow area that is optimized for a single flight point. It is also possible to alter the flow area between two adjacent vane airfoils by providing a variable airfoil that rotates about a given axis to vary the flow area.

SUMMARY

A vane assembly for a gas turbine engine according to an exemplary embodiment of this disclosure includes, among other possible features, a first platform, a second platform spaced from the first platform, and a first variable airfoil that extends radially across an annulus between the first platform and the second platform. One of a radial outer portion and a radial inner portion of the variable airfoil includes a rotational shaft and the other of the radial outer portion and the radial inner portion includes a ball and socket joint that rotationally connect the first variable airfoil relative to the first platform and the second platform.

In a further embodiment of the forgoing vane assembly embodiment, a fixed airfoil can be integrally formed with at least one of the first platform and the second platform and positioned adjacent to the first variable airfoil.

In a further embodiment of either of the foregoing vane assembly embodiments, a second variable airfoil can be positioned on an opposite side of the fixed airfoil from the first variable airfoil.

In a further embodiment of any of the foregoing vane assembly embodiments, the first platform can be skewed relative to the second platform.

In a further embodiment of any of the foregoing vane assembly embodiments, the ball and socket joint can include a ball portion that is rotationally received by a socket portion.

In a further embodiment of any of the foregoing vane assembly embodiments, the socket portion can include a close-ended portion.

In a further embodiment of any of the foregoing vane assembly embodiments, the ball and socket joint can include a ball portion that extends from the first variable airfoil and a socket portion that extends at least partially through one of the first platform and the second platform.

In a further embodiment of any of the foregoing vane assembly embodiments, the ball and socket joint includes a ball portion that extends from one of the first platform and the second platform and a socket portion that extends at least partially through the first variable airfoil.

In a further embodiment of any of the foregoing vane assembly embodiments, a seal can be disposed in a groove of a channel of one of the first platform and the second platform, and the seal can surround a socket portion of the ball and socket joint.

In a further embodiment of any of the foregoing vane assembly embodiments, a rod can extend from one of the first platform and the second platform to maintain a position of the socket portion.

In a further embodiment of any of the foregoing vane assembly embodiments, the rotational shaft can be positioned at the radial outer portion and the ball and socket joint can be positioned at the radial inner portion.

A gas turbine engine according to another exemplary embodiment of this disclosure includes a first platform, a second platform, and a variable airfoil that extends between the first platform and the second platform. The variable airfoil is rotationally connected to at least one of the first platform and the second platform with a ball and socket joint that includes a ball portion that is circumferentially rotatable within a socket portion.

In a further embodiment of the foregoing gas turbine engine embodiment, the vane assembly can include a turbine vane assembly.

In a further embodiment of either of the foregoing gas turbine engine embodiments, the ball portion can extend from the variable airfoil and the socket portion can extend at least partially through one of the first platform and the second platform.

In a further embodiment of any of the foregoing gas turbine engine embodiments, the ball portion can extend from one of the first platform and the second platform and said socket portion can extend at least partially through the variable airfoil.

In a further embodiment of any of the foregoing gas turbine engine embodiments, the socket portion can bridge a split line between the vane assembly and an adjacent vane assembly.

In a further embodiment of any of the foregoing gas turbine engine embodiments, the socket portion can be received in a channel of a mate face of one of the first platform and the second platform.

A method for providing a vane assembly for a gas turbine engine according to an exemplary embodiment of this disclosure includes rotationally connecting a variable airfoil to a first platform of the vane assembly with a ball and socket joint.

In a further embodiment of the foregoing method embodiment, the method can include rotationally connecting the variable airfoil to a second platform of the vane assembly with a rotational shaft.

In a further embodiment of either of the foregoing method embodiments, the step of rotationally connecting can include inserting a ball portion of the ball and socket joint within a socket portion of the ball and socket joint.

The various features and advantages of this disclosure will become apparent to those skilled in the art from the following detailed description. The drawings that accompany the detailed description can be briefly described as follows.

BRIEF DESCRIPTION OF THE DRAWINGS

FIG. 4 illustrates a ball and socket joint of a vane assembly.

FIG. 5 illustrates another example ball and socket joint of a vane assembly.

DETAILED DESCRIPTION

Figure 1:
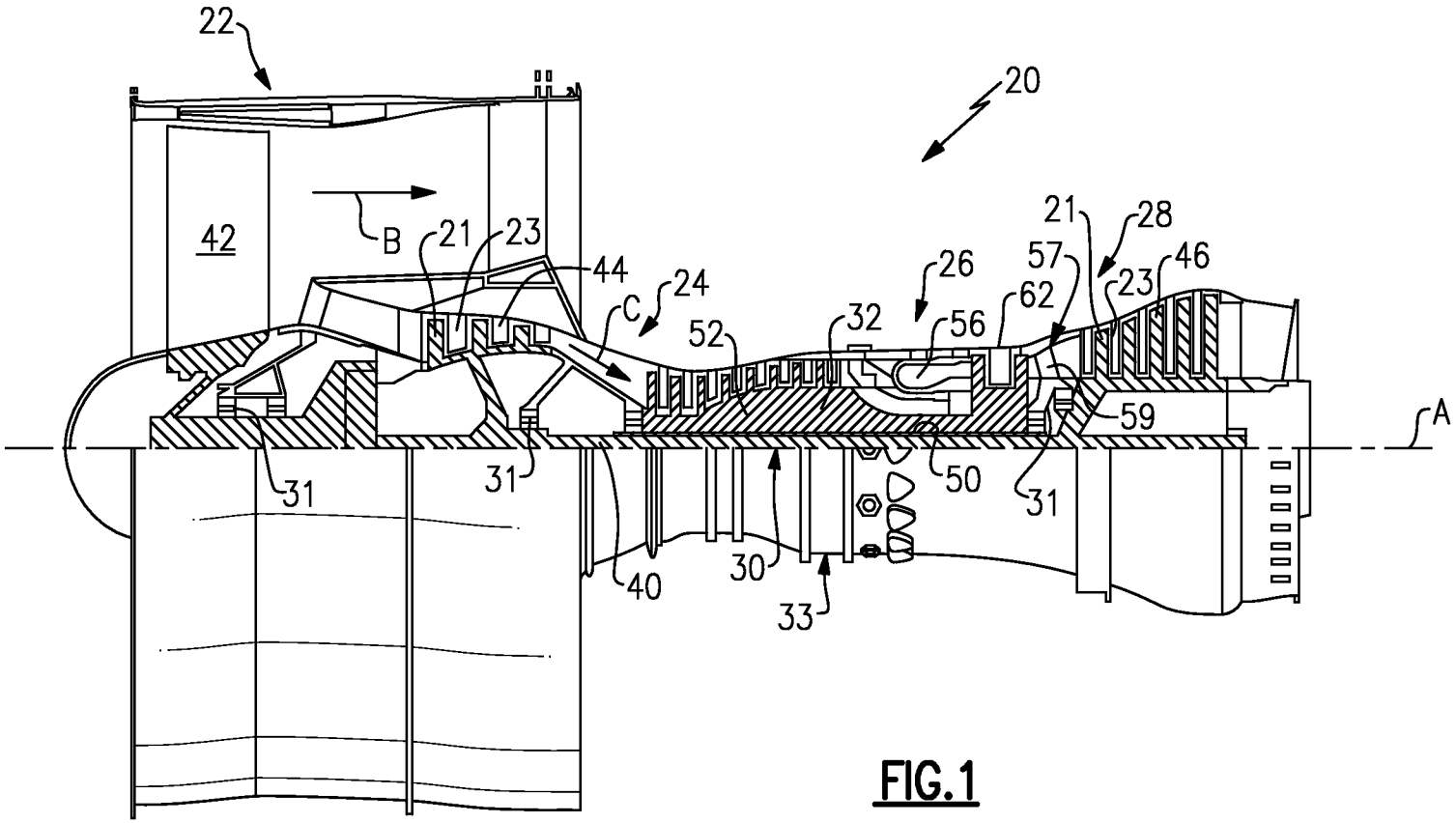
FIG. 1 illustrates a schematic cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems or features. The fan section 22 drives air along a bypass flow path B, while the compressor section 24 drives air along a core flow path C for compression and communication into the combustor section 26. The hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of turbine engines, including but not limited to three-spool engine architectures.

The gas turbine engine 20 generally includes a low speed spool 30 and a high speed spool 32 mounted for rotation about an engine centerline longitudinal axis A relative to an engine static structure 33 via several bearing structures 31. It should be understood that various bearing structures 31 at various locations may alternatively or additionally be provided.

The low speed spool 30 generally includes an inner shaft 40 that interconnects a fan 42, a low pressure compressor 44 and a low pressure turbine 46. The high speed spool 32 includes an outer shaft 50 that interconnects a high pressure compressor 52 and a high pressure turbine 62. In this example, the inner shaft 40 and the outer shaft 50 are supported at various axial locations by bearing structures 31 positioned within the engine static structure 33.

A combustor 56 is arranged between the high pressure compressor 52 and the high pressure turbine 62. A mid-turbine frame 57 of the engine static structure 33 is arranged generally between the high pressure turbine 62 and the low pressure turbine 46. The mid-turbine frame 57 can support one or more bearing structures 31 in the turbine section 28. The inner shaft 40 and the outer shaft 50 are concentric and rotate via the bearing structures 31 about the engine centerline longitudinal axis A, which is collinear with their longitudinal axes.

The core airflow is compressed by the low pressure compressor 44 and the high pressure compressor 52, is mixed with fuel and burned in the combustor 56, and is then expanded over the high pressure turbine 62 and the low pressure turbine 46. The mid-turbine frame 57 includes airfoils 59 which are in the core airflow path. The high pressure turbine 62 and the low pressure turbine 46 rotationally drive the respective low speed spool 30 and the high speed spool 32 in response to the expansion.

The compressor section 24 and the turbine section 28 can each include alternating rows of rotor assemblies 21 and vane assemblies 23. The rotor assemblies 21 include a plurality of rotating blades, and each vane assembly 23 includes a plurality of vanes. The blades of the rotor assemblies 21 create or extract energy (in the form of pressure) from the airflow that is communicated through the gas turbine engine 20. The vanes direct airflow to the blades to either add or extract energy.

Figure 2:
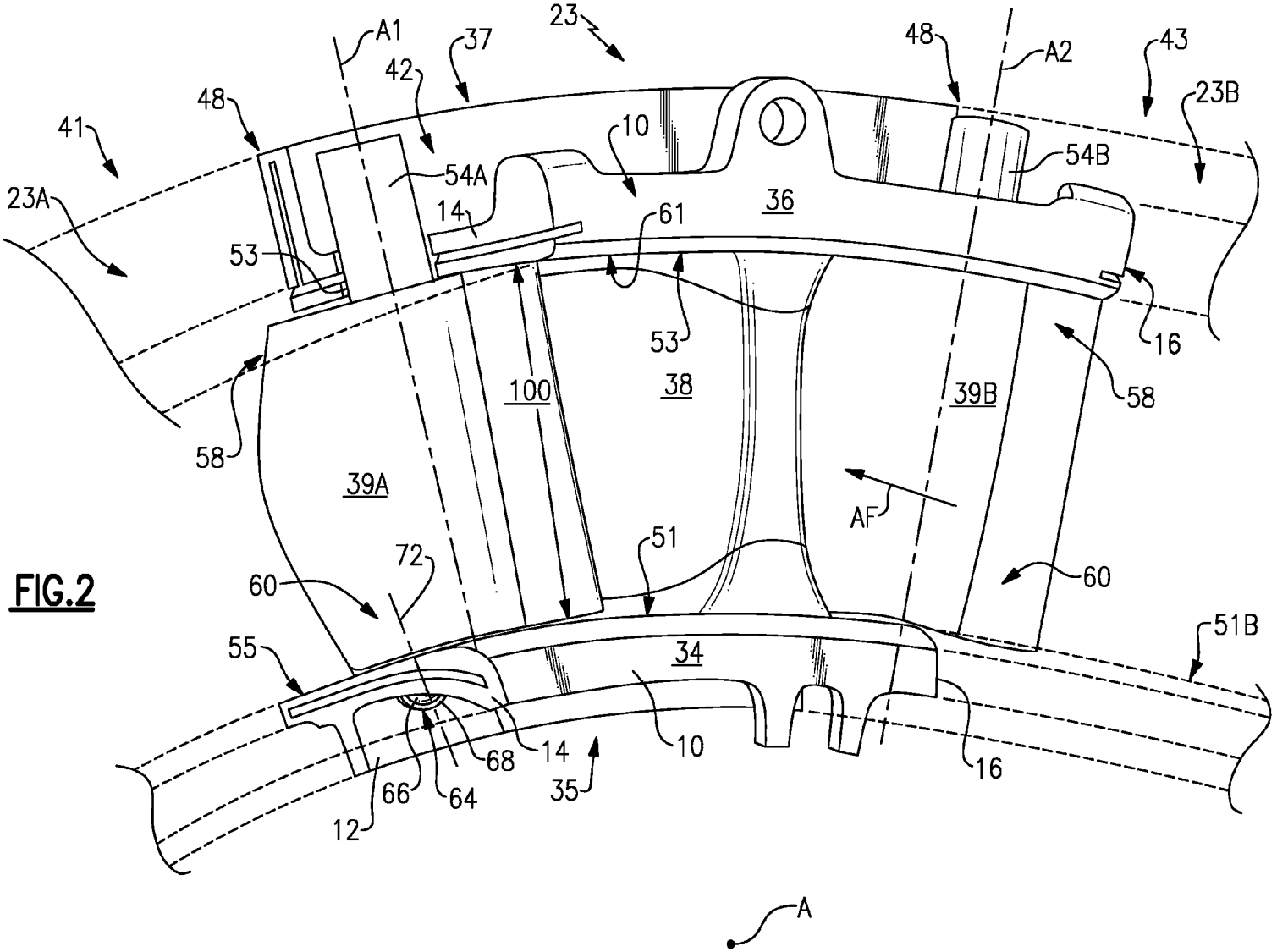
FIG. 2 illustrates a vane assembly of a gas turbine engine.

FIG. 2 illustrates an example vane assembly 23 that can be incorporated into a gas turbine engine, such as the gas turbine engine 20. In this example, the vane assembly 23 is a turbine vane assembly. However, the vane assembly 23 could be incorporated into other sections of a gas turbine engine 20, including but not limited to, the compressor section 24.

A plurality of vane assemblies 23 can be mechanically attached to one another and annularly disposed about the engine centerline axis A to form a full ring vane assembly. The vane assembly 23 can include either fixed vanes (i.e., static vanes), variable vanes that rotate to alter a flow area associated with the vane, or both, as is discussed in greater detail below.

The vane assembly 23 includes a first platform 34 and a second platform 36 spaced from the first platform 34. One of the first platform 34 and the second platform 36 is positioned on an inner diameter side 35 of the vane assembly 23 and the other of the first platform 34 and the second platform 36 is positioned on an outer diameter side 37 of the vane assembly 23. A stationary airfoil 38 and variable airfoils 39A, 39B can extend between the first platform 34 and the second platform 36. In other words, the stationary airfoil 38 and the variable airfoils 39A, 39B extend radially across an annulus 100 between the first platform 34 and the second platform 36. The vane assembly 23 could also include only a single airfoil or multiple airfoils.

The first platform 34 and the second platform 36 each include a leading edge rail 10, a trailing edge rail 12, and opposing mate faces 14, 16 that extend axially between the leading edge rails 10 and the trailing edge rails 12. Airflow AF is communicated in a direction from the leading edge rail 10 toward the trailing edge rail 12 during engine operation.

Additional vane assemblies 23A, 23B (portions shown in phantom) can be positioned adjacent to the vane assembly 23, with the vane assembly 23A positioned at a first side 41 of the vane assembly 23 and the vane assembly 23B positioned on an opposite, second side 43 of the vane assembly 23. For simplicity, only portions of the vane assemblies 23A and 23B are illustrated by FIG. 2. A plurality of vane assemblies 23 could be annularly disposed about the engine centerline axis A to form a full ring vane assembly. The adjacent vane assemblies 23, 23A and 23B can be mechanically attached (e.g., bolted together) at the either the first platforms 34 or the second platforms 36.

A split line 48 (i.e., partition) is established between the adjacent vane assemblies 23, 23A and 23B. A radially outer surface 55 of the first platform 34 defines a gas path 51 of the first platform 34, and a radially inner surface 61 of the second platform 36 establishes a gas path 53 of the second platform 36. The gas paths 51, 53 of the first platform 34 and the second platform 36 extend across an entirety of the radially outer surface 55 and the radially inner surface 61 of the first and second platforms 34, 36, respectively.

The stationary airfoil 38 is integrally formed with at least one of (or both) the first platform 34 and the second platform 36. Therefore, the first platform 34 and the second platform 36 of the vane assembly 23 are coupled relative to one another. The variable airfoils 39A, 39B can rotate relative to the first platform 34 and the second platform 36 about a first axis of rotation A1 and a second axis of rotation A2, respectively. The first axis of rotation A1 and the second axis of rotation A2 are generally perpendicular to the engine centerline axis A. The first axis of rotation A1 is transverse to the second axis of rotation A2. Put another way, the first axis of rotation A1 is two airfoil pitches away from the second axis of rotation A2 and the stationary airfoil 38 is one airfoil pitch away from the first axis of rotation A1, where an airfoil pitch is defined as the angle between two stacking axes of adjacent airfoils in a ring.

The first platform 34 of the vane assembly 23 can be skewed (i.e., distorted or biased) relative to the second platform 36. The first platform 34 is shifted counter-clockwise relative to the second platform 36, or vice-versa, to skew the first platform 34 and the second platform 36 relative to one another. In this example, the mate face 14 of the first platform 34 is circumferentially skewed (in a counterclockwise direction) beyond the mate face 14 of the second platform 36, while the mate face 16 of the second platform 36 is circumferentially skewed (in a clockwise direction) beyond the mate face 16 of the first platform 34.

The skewed first and second platforms 34, 36 position a radial inner portion 60 of the variable airfoil 39A completely on the gas path 51 of the first platform 34. A radial inner portion 60 of the variable airfoil 39B extends circumferentially beyond the mate face 16 (i.e., beyond the periphery) of the first platform 34 such that it extends entirely on a gas path 51B of the adjacent vane assembly 23B and not on the gas path 51 of the first platform 34 of the vane assembly 23. An opposite arrangement could be provided where the first platform 34 and the second platform 36 are skewed in an opposite direction so long as the mate faces 14, 16 are offset relative to one another. The axes of rotation A1 and A2 of the variable airfoils 39A, 39B are directly aligned with the split lines 48 of the vane assembly 23 as a result of the skewed nature of the first platform 34 and the second platform 36. In other words, rotational shafts 54A, 54B of the variable airfoils 39A, 39B can be coplanar with the split lines 48.

Figure 3:
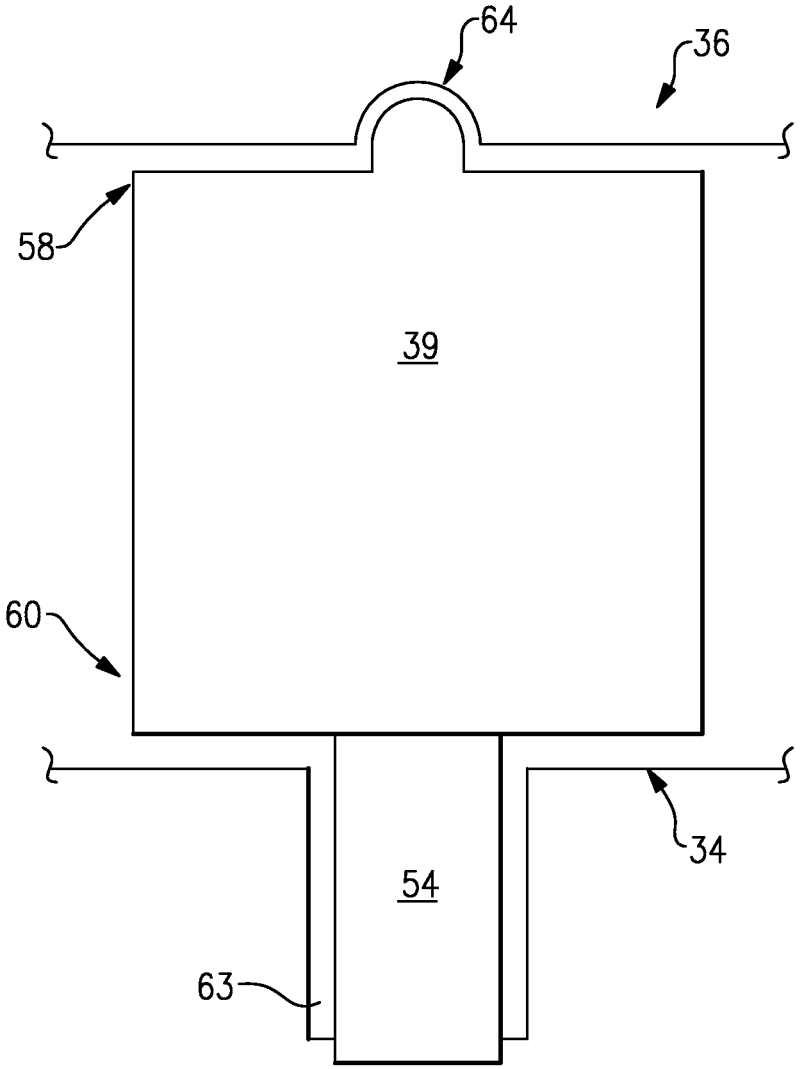
FIG. 3 illustrates another example vane assembly.

In the exemplary embodiment, rotational shafts 54A, 54B of the vane assembly 23 are positioned at radial outer portions 58 of the variable airfoils 39A, 39B and ball and socket joints 64 are positioned at radial inner portions 60 of the variable airfoils 39A, 39B to rotationally connect the variable airfoils 39A, 39B to the first platform 34 and the second platform 36. It should also be understood that an opposite configuration is contemplated in which the rotational shafts 54A, 54B are positioned at the radial inner portions 60 and the ball and socket joints 64 are positioned at the radial outer portions 58 (See FIG. 3). The rotational shafts 54A, 54B can be received by and extend through openings 63 of the second platform 36.

FIG. 4 illustrates an example ball and socket joint 64 that can be incorporated into a vane assembly 23. In this example, the ball and socket joint include a ball portion 66 and a socket portion 68. The socket portion 68 rotationally receives the ball portion 66.

In one exemplary embodiment, the ball portion 66 extends from a variable airfoil 39 and the socket portion 68 extends through a portion of either the first platform 34 or the second platform 36 depending on whether the ball and socket joint 64 is positioned at the radial inner portion 60 or the radial outer portion 58 of the vane assembly 23. An opposite configuration is also contemplated in which the ball portion 66 can extend from either the first platform 34 or the second platform 36 and the socket portion 68 is defined by the variable airfoil 39 (See FIG. 5). The ball portion 66 can be either press-fit or integrally cast and the socket portion 68 can be either cast or machined.

The socket portion 68 of the exemplary embodiment extends radially inwardly from a gas path 51 of the first platform 34 (or, alternatively, the socket portion 68 can extend radially outwardly from the gas path 53 of the second platform 36). The socket portion 68 includes a close-ended portion 70 for sealing the ball and socket joint 64. The socket portion 68 may extend to a radial depth D that is less than a depth of either of the leading edge rail 10 or the trailing edge rail 12.

Figure 6A:
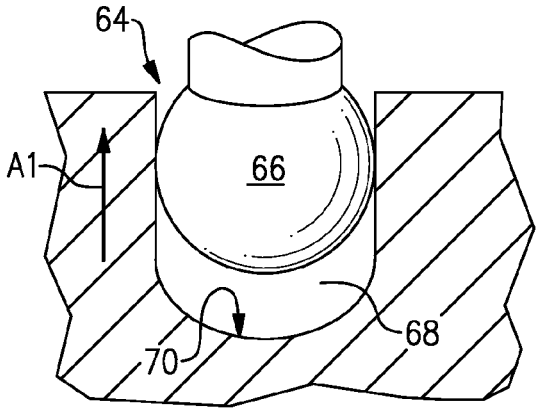
FIGS. 6A-6D illustrate additional views of the exemplary ball and socket joint of FIG. 4.
Figure 6B:
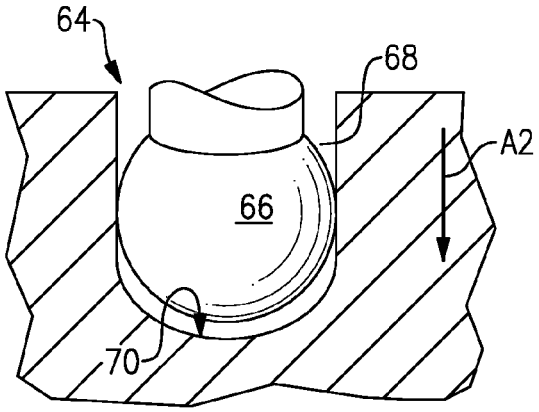
Figure 6C:
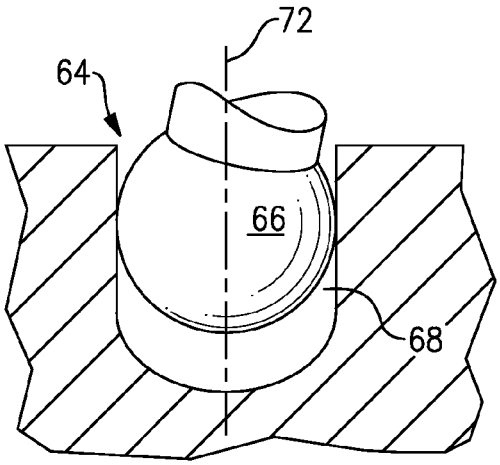
Figure 6D:
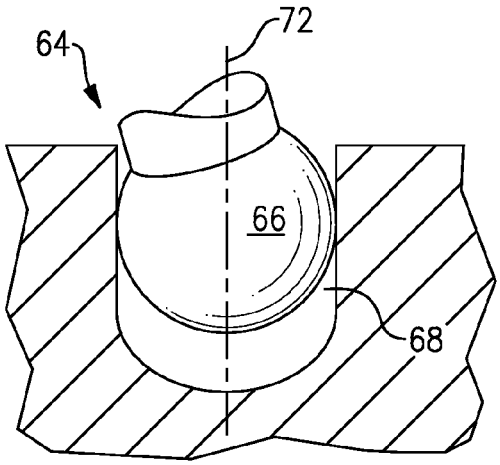

FIGS. 6A through 6D schematically illustrate a range of motion of the ball and socket joint 64. In other words, the ball portion 66 is movable relative to the socket portion 68 to allow for thermal and mechanical movement associated with the variable airfoil 39. For example, the ball portion 66 can be moved in a radially outward direction A1 (FIG. 6A) or a radially inward direction A2 toward the closed-ended portion 70 of the socket portion 68 (FIG. 6B). The ball portion 66 can also be tilted relative to, or rotated circumferentially about, an axis 72 associated with the socket portion 68 (FIGS. 6C and 6D). The axis 72 of the socket portion is offset from the axis A1, A2 of the rotational shafts 54A, 54B (See FIG. 2).

Figure 7:
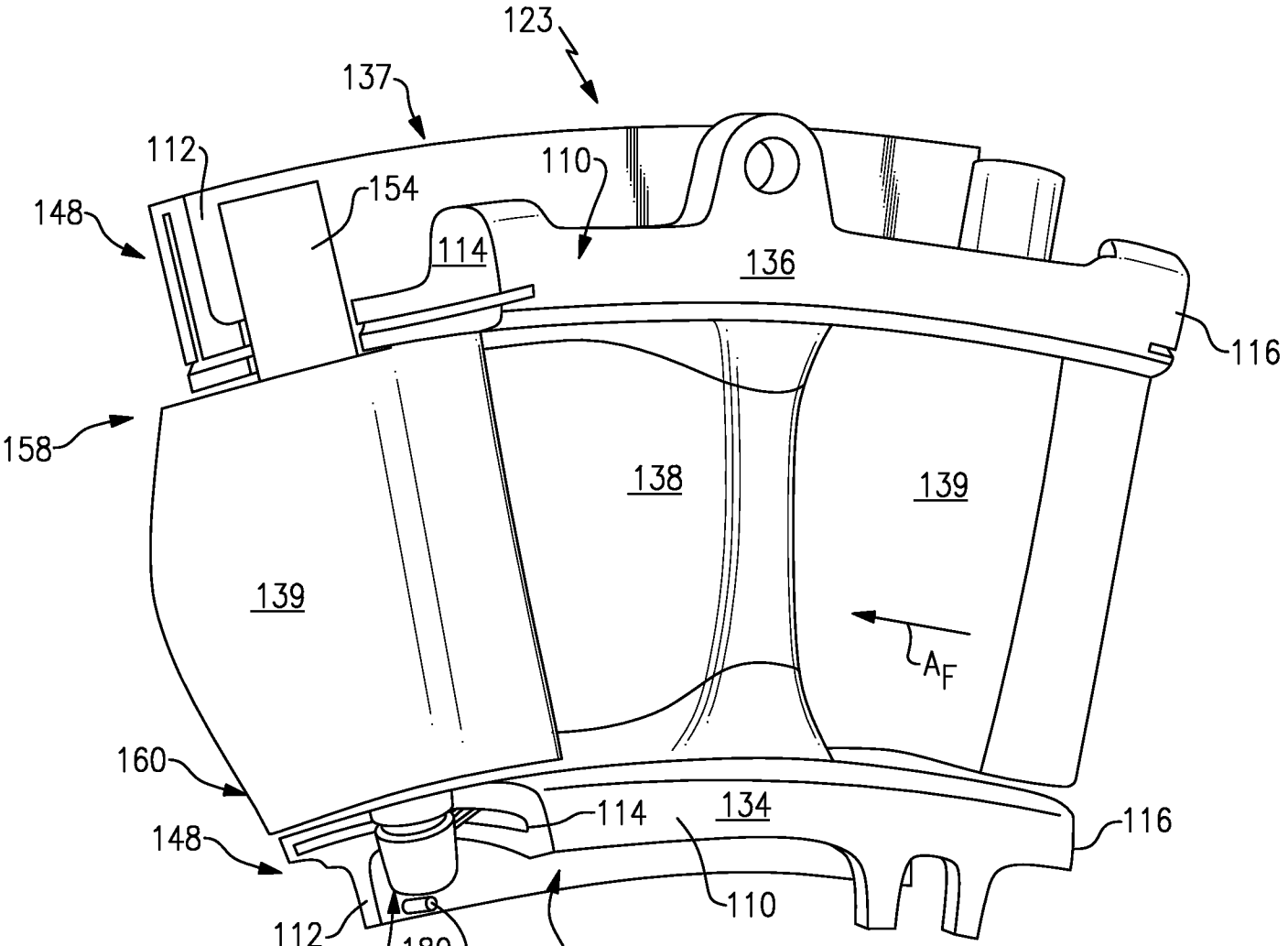
FIG. 7 illustrates yet another example vane assembly of a gas turbine engine.

FIG. 7 illustrates another example vane assembly 123. The vane assembly 123 includes a first platform 134 and a second platform 136 spaced from the first platform 134. One of the first platform 134 and the second platform 136 is positioned on an inner diameter side 135 of the vane assembly 123 and the other of the first platform 134 and the second platform 136 is positioned on an outer diameter side 137 of the vane assembly 123. A stationary airfoil 138 and one or more variable airfoils 139 can extend radially between the first platform 134 and the second platform 136.

The first platform 134 and the second platform 136 each include a leading edge rail 110, a trailing edge rail 112, and opposing mate faces 114, 116 that extend axially between the leading edge rails 110 and the trailing edge rails 112. Airflow AF is communicated in a direction from the leading edge rail 110 toward the trailing edge rail 112 during engine operation.

Unlike the vane assembly 23, the first platform 134 of the vane assembly 123 is not skewed relative to the second platform 136. That is, the mate faces 114, 116 of the first platform 134 and the second platform 136 extend in the same radial plane. Therefore, in the illustrated example, the variable airfoil(s) 139 extend circumferentially beyond the mate faces 114, 116 (i.e., beyond the periphery) such that the variable airfoils 139 bridge a split line 148 established between adjacent vane assemblies. In this example, one of a radial outer portion 158 and a radial inner portion 160 of the variable airfoil(s) 139 is rotationally connected to the vane assembly 123 with a rotational shaft 154 and the other of the radial outer portion 158 and the radial inner portion 160 is rotationally connected to the vane assembly 123 with a ball and socket joint 164.

Figure 8:
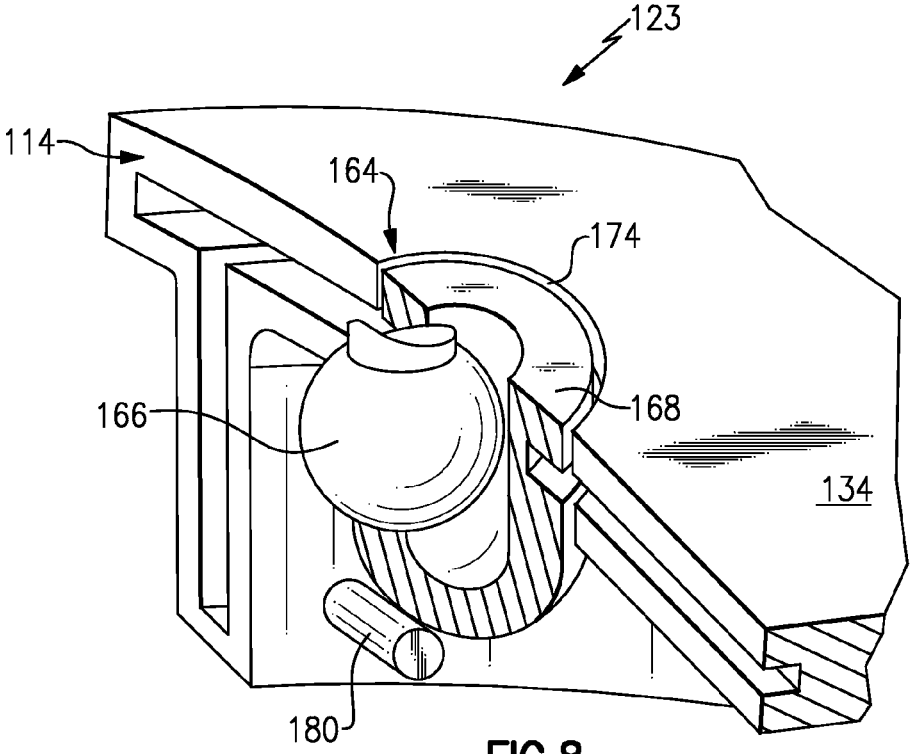
FIG. 8 illustrates an example ball and socket joint of a vane assembly.

FIG. 8 illustrates an example ball and socket joint 164 that can be incorporated into the vane assembly 123 for rotationally connecting a variable airfoil (not shown) thereto. The ball and socket joint 164 could be disposed relative to either the radial outer portion 158 or the radial inner portion 160 of a variable airfoil 139 (See FIG. 7). The ball and socket joint 164 includes a ball portion 166 and a socket portion 168 that receives the ball portion 166. The ball portion 166 is circumferentially rotatable within the socket portion 168.

In the exemplary embodiment, the socket portion 168 is received by a channel 174 formed in the mate face 114 of first platform 134 (or the second platform 136 if disposed at the radial outer portion 158). The channel 174 can be shaped to match the outer contour of the socket portion 168, which is cylindrical in this example.

Figure 9:
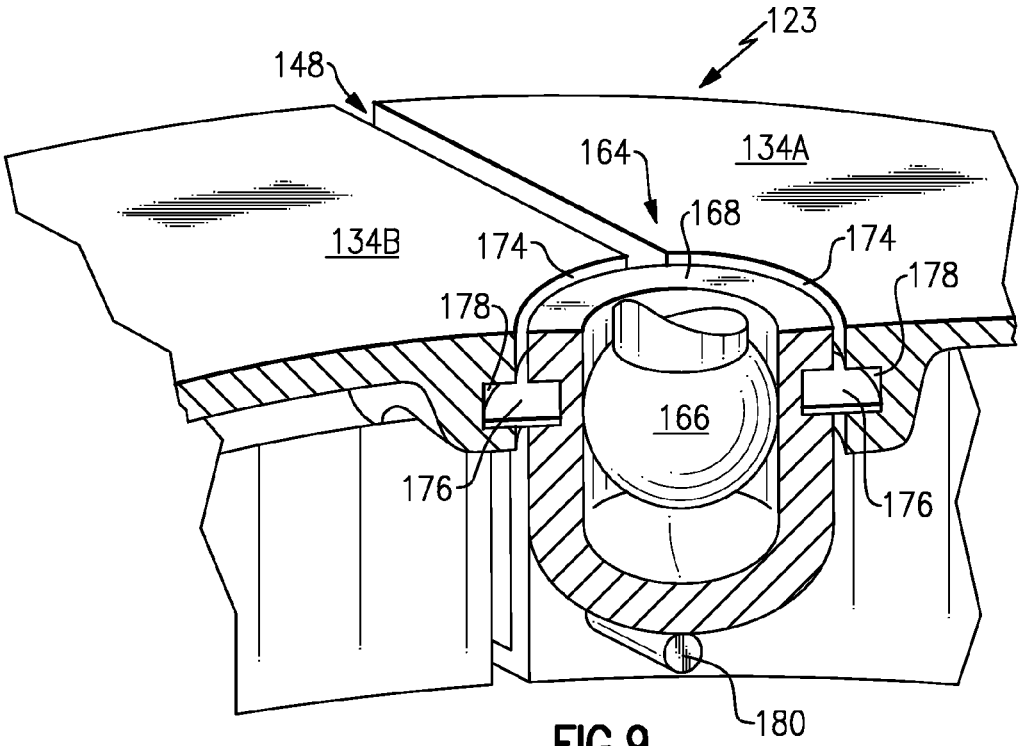
FIG. 9 illustrates another example ball and socket joint.

Referring to FIG. 9, the socket portion 168 bridges the split line 148 established between adjacent platforms 134A, 134B of the vane assembly 123. In other words, the socket portion 168 is received in opposing channels 174 of the platforms 134A, 134B.

A seal 176, such as a feather seal or other suitable seal, can be received in a slot 178 of the channels 174. In one example, the seal 176 is cylindrical and surrounds the socket portion 168. The seal 176 seals the ball and socket joint 164 to reduce airflow leakage at the ball and socket joint 164. A rod 180 can also extend from the first platform 134. The rod 180 keeps the socket portion 168 from falling out of the vane assembly 123. In one example, the rod 180 is cast into the first platform 134. The rod 180 could take any convenient size or shape for supporting the socket portion 168.

Although the different examples have a specific component shown in the illustrations, embodiments of this disclosure are not limited to those particular combinations. It is possible to use some of the components or features from one of the examples in combination with features or components from another one of the examples.

Furthermore, the foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

I claim:

1. A vane assembly for a gas turbine engine, comprising:

a first platform;

a second platform spaced from said first platform; and said first platform is skewed relative to said second platform; and a first variable airfoil that extends radially across an annulus between said first platform and said second platform, wherein one of a radial outer portion and a radial inner portion of said variable airfoil includes a rotational shaft and the other of said radial outer portion and said radial inner portion includes a ball and socket joint that rotationally connect said first variable airfoil relative to said first platform and said second platform.

2. The assembly as recited in claim 1, comprising a fixed airfoil that is integrally formed with at least one of said first platform and said second platform and positioned adjacent to said first variable airfoil.

3. The assembly as recited in claim 2, comprising a second variable airfoil positioned on an opposite side of said fixed airfoil from said first variable airfoil.

4. The assembly as recited in claim 1, wherein said ball and socket joint includes a ball portion that is rotationally received by a socket portion.

5. The assembly as recited in claim 4, wherein said socket portion includes a close-ended portion.

6. The assembly as recited in claim 1, wherein said ball and socket joint includes a ball portion that extends from said first variable airfoil and a socket portion that extends at least partially through one of said first platform and said second platform.

7. The assembly as recited in claim 1, wherein said ball and socket joint includes a ball portion that extends from one of said first platform and said second platform and a socket portion that extends at least partially through said first variable airfoil.

8. The assembly as recited in claim 1, comprising a seal disposed in a groove of a channel of one of said first platform and said second platform, wherein said seal surrounds a socket portion of said ball and socket joint.

9. A vane assembly for a gas turbine engine, comprising:

a first platform;

a second platform spaced from said first platform;

a first variable airfoil that extends radially across an annulus between said first platform and said second platform, wherein one of a radial outer portion and a radial inner portion of said variable airfoil includes a rotational shaft and the other of said radial outer portion and said radial inner portion includes a ball and socket joint that rotationally connect said first variable airfoil relative to said first platform and said second platform;

a seal disposed in a groove of a channel of one of said first platform and said second platform, wherein said seal surrounds a socket portion of said ball and socket joint; and a rod that extends from one of said first platform and said second platform to maintain a position of said socket portion.

10. The assembly as recited in claim 1, wherein said rotational shaft is positioned at said radial outer portion and said ball and socket joint is positioned at said radial inner portion.

11. The assembly as recited in claim 1, wherein one of a trailing edge, radially outer airfoil portion and a trailing edge, radially inner airfoil portion of said first variable airfoil is positioned entirely on a gas path of said first platform and the other of said trailing edge, radially outer portion and said trailing edge, radially inner portion of said first variable airfoil extends circumferentially beyond a mate face of said second platform.

* * * * *